United States Patent [19]

Bienwald

[11] Patent Number: 4,508,417

[45] Date of Patent: Apr. 2, 1985

[54] PLUG-IN WIRE TERMINAL SYSTEM

[75] Inventor: F. Wolfgang Bienwald, Melville, N.Y.

[73] Assignee: Leviton Manufacturing Company, Inc., Little Neck, N.Y.

[21] Appl. No.: 483,794

[22] Filed: Apr. 11, 1983

[51] Int. Cl.[3] ..... H01R 17/04

[52] U.S. Cl. ..... 339/176 L; 339/180; 339/217 S

[58] Field of Search ..... 339/217 S, 252 P, 178, 339/179, 176 L, 180

[56] References Cited

U.S. PATENT DOCUMENTS

| | | | |
|---|---|---|---|
| 3,170,750 | 2/1965 | Appleton | 339/180 |
| 3,246,281 | 4/1966 | Cunningham | 339/217 S |
| 3,500,298 | 3/1970 | Williamson et al. | 339/217 S |
| 3,957,337 | 5/1976 | Damiano | 339/217 S |

FOREIGN PATENT DOCUMENTS

| | | | |
|---|---|---|---|
| 57551 | 5/1946 | Netherlands | 339/180 |

*Primary Examiner*—John McQuade

*Attorney, Agent, or Firm*—Paul J. Sutton

[57] ABSTRACT

The present invention provides a plug-in wire terminal system for a lamp socket. The system includes a bushing mounted in a passage through the base wall of the socket and a terminal gripping the lead of a connecting conductor that is adapted to plug into the hollow core of the bushing. The terminal is permanently mounted in the bushing by way of an outwardly biased cone portion that includes a plurality of biasable side strips that snap out once the cone passes an internal shoulder in the core of the bushing. The terminal has a biased contact portion that electrically connects the terminal with the bushing. The bushing includes a flared inner rim that both holds the bushing in place and electrically connects the bushing to a bottom flange extension of the screw shell mounted in the socket.

7 Claims, 4 Drawing Figures

PLUG-IN WIRE TERMINAL SYSTEM

This invention relates generally to connecting devices for electrically connecting a conductor to the base of a lamp socket, and in particular to a system for a snap-in terminal for the base of the lamp socket.

A wire conductor is generally attached to the base of a lamp socket by a terminal that grips the wire strands of a conductor and in addition is pressed under the flared rim of a bushing that extends through the base, or end wall, of a lamp socket and that is pressed to the base flange of the screw shell and the end of the center contact.

One disadvantage of such the prior art system is that it is relatively difficult to assemble since the end of the terminal must be press mounted under the flared rim of the bushing. Another difficulty is that the terminal must lie at right angles to the bushing and, since the rim of the bushing should not extend beyond the outer surface of the end wall of the socket, a channel must be provided in the outer surface of the end wall both for the terminal and the conductor to clear the socket. Also the terminal and the lead portion of the conductor extend transverse to the side walls of the socket and thus strain is created at the terminal when the conductors turn to pass to the electrical contacts which are positioned in an axial direction relative to the cylindrical socket. Another disadvantage of the prior art is that it is necessary to manufacture sockets with slot and recesses for the terminals and conductor leads formed in the outside surface of the end wall of the socket.

Accordingly, it is an object of the present invention to provide a terminal system that overcomes the disadvantages of the prior art system described above.

Another object of the present invention is to provide a conductor plug-in terminal system that includes a terminal that is plugged into the bushing in the end wall of the lamp socket.

Yet another object of the present invention is to provide a terminal for permanently plugging into the bushing of a socket that includes a biased head portion that is locked inside the bushing.

Another object of this invention is to provide a plug-in terminal that can be easily permanently mounted to the bushing in the base of a lamp socket.

Still another object of this invention is to provide a plug-in terminal that is single and inexpensive to manufacture.

Still another object of this invention is to provide a plug-in terminal that is biasedly snap-mounted in the socket bushing and that is electrically connected to the bushing at a biased contact portion.

Yet a further object of this invention is to provide a plug-in terminal system that provides a terminal and lead orientation that is parallel to the axis of the bushing in the base wall of the socket.

Another object of this invention is to provide a plug-in terminal system that provides a direct plug in to the socket bushing with a substantially flat outer surface of the base wall of the socket.

The invention will be more clearly understood from the following description of a specific embodiment of the invention, together with the accompanying drawings, wherein similar reference characters denote similar elements throughout the several views, and in which.

REFERENCE IS NOW MADE IN DETAIL TO THE DRAWINGS

Figure 1:
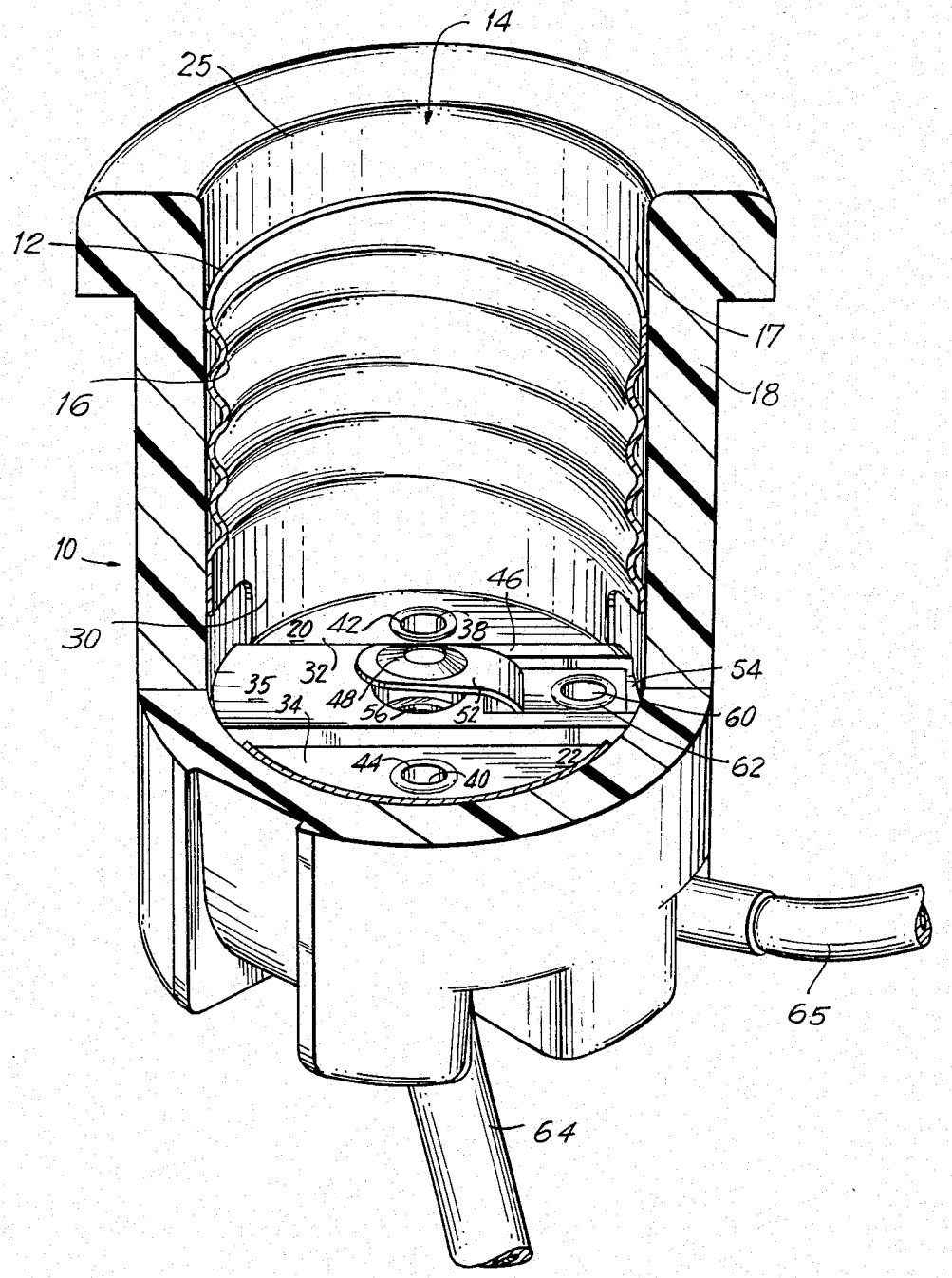
FIG. 1 shows a fragmented perspective view of the socket body revealing the interior of the socket.
Figure 3:
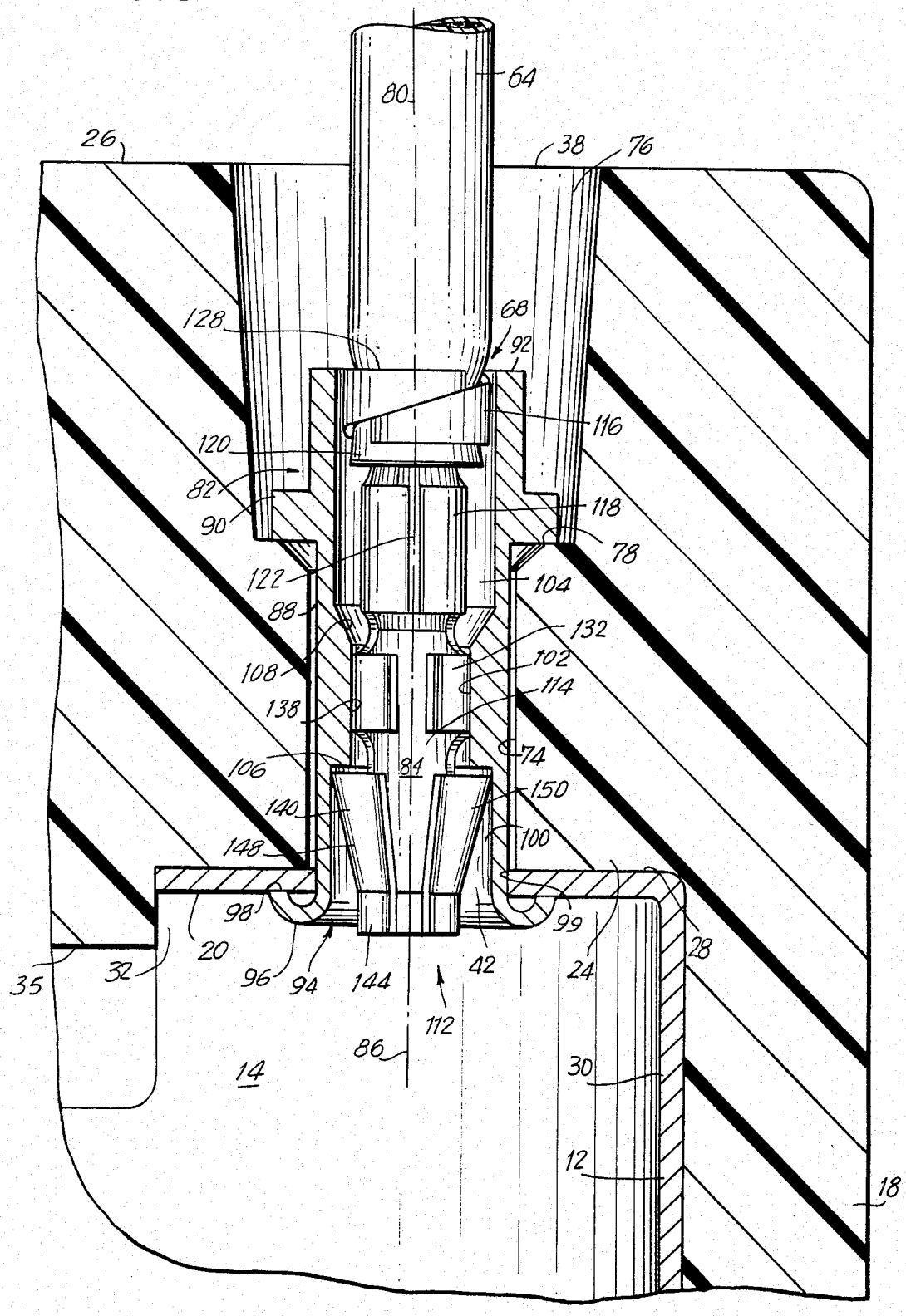
FIG. 3 shows a cross-sectional view of the present invention taken along line 3—3 in FIG. 2.

A fragmentary perspective view of a porcelin body 10 with an aluminum substantially cylindrical screw shell 12 fitted around the inner surface 17 of side wall 18 of a generally cylindrical hollow socket 14 formed by body 10. Screw shell 12 is adapted to receive the base of an incandescent lamp(not shown). Screw shell 12 is provided with screw threads 16 disposed adjacent to inner surface 17 in a conventional manner. Shell 12 is further provided with a pair of flanged portions 20 and 22 which are oppositely positioned and extend along opposite portions of inner surface 28 of socket base wall, or end wall, 24 of socket 14. Open side 25 of socket 14 is disposed opposite inner surface 28. End wall 24, best seen in FIG. 3, includes outer surface 26 and inner surface 28 each of which are disposed approximately perpendicular to the imaginary axis of cylindrical socket 14. Flanged portions 20 and 22 are joined to screw threads 16 via joining sections 30 of shell 12, only one of which can be seen in FIG. 1. As seen in FIGS. 1 and 3, flanged portions 20 and 22 specifically are positioned in oppositely positioned recesses 32 and 34 respectively which are formed by side wall 18 and raised portion 35, which in turn extends into socket 14 from inner surface 28 and which separates recesses 32 and 34.

Figure 2:
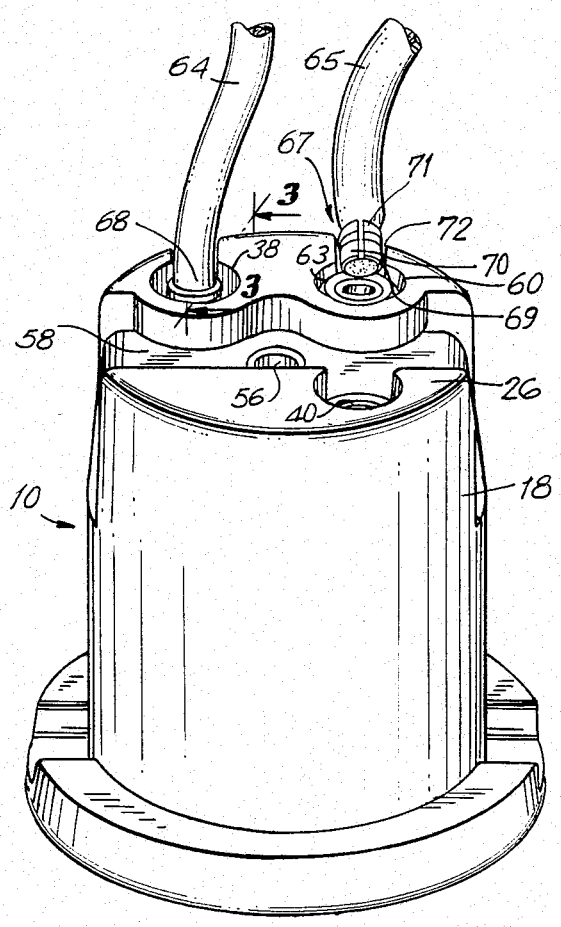
FIG. 2 shows the top of the socket body.

As seen in FIG. 1, a first passage 38 and a second passage 40 are formed by end wall 24 and extend between outer surface 26 and inner surface 28. First and second passages 38 and 40 have inner edges that are coextensive with holes 42 and 44 formed in flanged portions 20 and 22 respectively of shell 12. FIG. 2, which is a perspective showing the outer surface 26 of end wall 24 of socket body 10, shows, along with FIG. 1, that second passage 40 is free. First passage 38, as will be discussed in detail below, provides passage for one of the two electrical contacts to the base of the incandescent lamp. Second passage 40 is to provide a passage for a grounding contact, which is not illustrated in the present embodiment since it would duplicate the details of the plug-in contact for first passage 38. In the event a ground contact is desired, second passage 40 would then be used in a manner to be described for first passage 38.

Before describing the details of the present invention as associated with first passage 38, a short description of the second electrical contact will be made. Briefly, as is known in the art, the bulb of an incandescent lamp has two separate base contacts: one is via the side of the base of the lamp via the screw shell, here shell 12. The other electrical contact is made at the center button of the base of the lamp via a center contact. As seen in FIG. 1, a center contact 46 having a center contact area 48 that is adapted to be in electrical contact with the button of the base of an incandescent lamp is connected to a mounting rivet at the opposite end of biased contact arm 52, which is shown preferably angled upwards as it extends towards center contact area 48 from depression 54 in raised portion 35 proximate to side wall 18. Center contact area 48 is preferably positioned over and spaced from center passage 56 formed through end wall 24 and which is also seen in FIG. 2. Passage 56 is for a securing screw(not shown) for securing socket body 10 to a lamp via a spring clip (not shown) that is adapted to be placed in spring screw slot 58 formed across the center of outer surface 26 of end wall 24 as illustrated in FIG. 2.

A center contact passage 60 is positioned proximate to side wall 18 of socket body 10 on an imaginary line approximately perpendicular to another imaginary line joining the centers of first and second passages 38 and 40. The opposed inner and outer annular flared rivet heads 62 and 63 respectively of a mounting rivet(not seen) are seen in FIGS. 1 and 2. First and second conductors 64 and 65 as seen in FIGS. 1 and 2 are associated with first and second passages 38 and 60 respectively. First and second conductors 64 and 65 include first and second leads 68 and 69 respectively to socket body 10. Each conductor also includes an external insulation covering a stranded wire, which will be discussed in detail with reference to first conductor 64 below.

As an example of the prior art and as illustrated in FIG. 2, second conductor 65 includes a prior art terminal 67 including a pair of end clamps designated as inner clamp 70 and outer clamp 71. Outer clamp 71 holds the insulation of the second conductor and inner clamp 70 holds the stranded conducting wire and in addition is pressed under outer flanged rim 63, so that an electrical contact is made between the wire, through the rivet, the center contact 46, and the button of the base of the lamp. Because prior art terminal 67 must extend transverse to outer surface 26, a channel 72 is formed for prior art terminal 67 and second lead 69.

In accordance with the present invention, first conductor 64 is electrically connected to the base of the bulb of the incandescent lamp via first passage 38, which is preferably cylindrical and which extends through end wall 24 approximately perpendicular to the planes of inner and outer surfaces 28 and 26.

Attention is now directed to FIG. 3, which is a section taken through line 3—3 of FIG. 2. First passage 38 is illustrated and includes inner cylindrical passage portion 74 having an inner diameter and an outer counterbored passage portion 76, which is preferably tapered inwardly from outer surface 26 to inner passage portion 74, which opens at inner surface 28.

The base diameter of counterbored outer passage portion 76 is larger than the inner diameter of inner passage portion 74 so that annular stop ledge 78 is formed between inner and outer passage portions 74 and 76. Inner and outer passage portions 74 and 76 have a first passage axis 80, which is approximately at right angles to inner surface 28.

In further accordance with the present invention, a bushing 82 of electrically conductive material such as brass and forming a hollow core 84 having a core axis 86 approximately coextensive with first passage axis 80 is fixedly mounted within first passage 38. Bushing 82 has an outer cylindrical wall surface 88 and a cylindrical flange stop 90 extending from wall surface 88 and which is in contact with stop ledge 78 and acts to prevent bushing 82 from moving within first passage 38 toward socket 14. Core 84 has an outer rim 92, which is disposed in outer counterbored passage portion 76 spaced from outer surface 26, and in addition has an opposed inner rim 94 coextensive with hole 42 of shell flanged portion 20. Inner rim 94 is engaged with shell flange portion 20 so that an electrical connection is made between shell 12 and bushing 82. In particular, inner rim 94 includes an approximately annular flared rivet head 96, which flares from inner rim 94 so that a semi-circular keeper is formed in a conventional manner. Flared head 96 is in pressing contact with shell flange 20 via annular head edge 98 so as to lock bushing 82 into tight engagement at bushing flange 90 with stop ledge 78 and to prevent the bushing from sliding outwardly from socket 14. In addition head edge 98 of head 96 is in electrical connection with shell flange 20. Inner rim 94 is in electrical engagement with shell flange 20 at two areas: at annular head edge 98 and at hole rim 99 of shell flange hole 42.

Hollow core 84 of bushing 82 includes an inner core portion 100 associated with inner rim 94, a middle core portion 102 adjoining inner core portion 100, and an outer core portion 104 adjoining middle core portion 102 and associated with outer rim 92. Inner, middle, and outer core portions 100,102, and 104 have respective inner diameter, a middle diameter, and an outer diameter. The middle diameter is smaller than the inner and outer diameters, which are preferably the same, as indicated in FIG. 3. An internal annular shoulder 106 is formed between inner core portion 100 and middle core portion 102. In addition, an annular sloped guide 108 is formed between middle and outer core portions 102 and 104.

Attention is now directed to terminal element 112, which can be seen in cross-section in FIG. 3. In addition, for purposes of exposition, terminal element body 12 is also shown in perspective in FIG. 4 in an embodiment that illustrates the element in the unmounted position prior to its being shaped to crimp, or grip, first lead 68 and is designated as terminal element 112'. Terminal element 112 in actuality is a type of plug, as will be explained. Terminal element 112 is made of an electrically conductive material such as phospher bronze. Terminal element 112 includes an elongated spine 114, which is viewable in FIG. 3, but, since spine 114 is opposite the cross-sectional plane 3—3 shown in FIG. 3, since 114 is best viewed in FIG. 4. Terminal element also includes a first sleeve 116 connected to one end of spine 114 and a second sleeve 118 also connected to spine 114 and spaced from but proximate to first sleeve 116. As seen in FIG. 3, insulation 120 of first lead 68 is positioned within and gripped by first sleeve 116; and stranded wire 122 of first lead 68 is positioned within and gripped by second sleeve 118.

Figure 4:
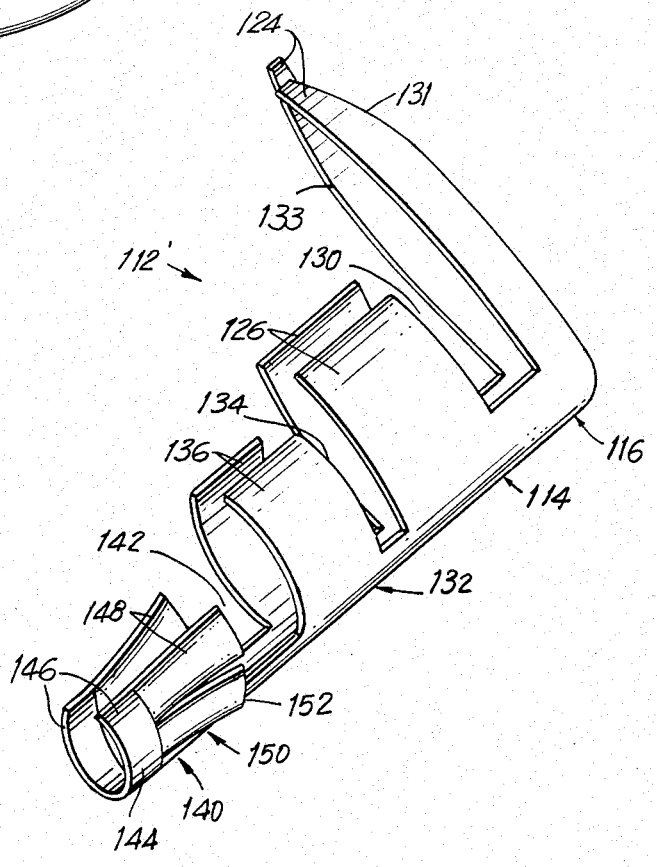
FIG. 4 shows a perspective view of the terminal according to the present invention before the terminal is crimped to the wire strands and the insulation of the conductor.

Lead 68 is first stripped of insulation 120 to expose wire 122. Insulation 120 is set into opposed paired flexible arms 124 of first sleeve 116, which are illustrated in FIG. 4 before the arms 124 are bent into sleeve 116 seen in FIG. 3, and stranded wire 122 is set into opposed paired flexible arms 126 of second sleeve 118, arms 126 being seen in FIG. 4. Paired arms 124 and 126 are then closed to the positions shown in FIG. 3. An observation is made here about this particular combination of first and second sleeves. First sleeve 116 is positioned within bushing 82 with the outer rim 128 of first sleeve 116, as illustrated in FIG. 3, on a level with outer edge 92 of bushing 82. First sleeve 116 has a circumference closely approximately the diameter of outer core portion 104 so that when first conductor 64 is bent or twisted, first sleeve 116 absorbs the turning strain against the inner walls of core 84 of bushing 82 and by this provides relief from strain caused by bending and prevents strain at wire strands 122. As best seen in FIG. 4 first and second sleeves 116 and 118, shown as paired arms 124 and 126, are preferably spaced proximate to one another, being separated by gap 130. The ends of paired arms 124 and 126 have opposed reverse tapers 131 and 133 to allow a non-interened folding together of the arms when they are folded around the insulation of first lead 68, that is, when first sleeve 116 is made, since it is preferable that arms 124 are sufficiently long enough to overlap, as seen in FIG. 3.

Terminal element 112 further includes contact portion 132 connected to spine 114 and spaced proximate to second sleeve 118 by gap 134, seen in FIG. 4. Contact portion 132 is substantially annular and preferably is formed from a pair of opposed arcuate arms 136 as seen in FIG. 4 which are each connected to spine 114. As seen in FIGS. 3 and 4, arms 136 do not meet and their ends are spaced proximate to one another so that contact portion 132 does not quite form a complete annular element. Contact portion is movable from an outward unbiased position, as shown in FIG. 4 to an inward biased position, as shown in FIG. 3. As shown in FIG. 3, contact portion 132 is positioned in biased contact with the inner surface of middle core portion 102 at substantially annular contact surface 138. Electrical connection is made between terminal body 112 and bushing body 82 at substantially annular contact surface 138. During the plugging-in process of terminal element 112 into bushing 82, when contact portion 132 is unbiased, contact portion 132 first meets middle core portion 102 at annular sloped guide 108, during which time contact portion 132 is pressed from its unbiased to its biased position in which state it is finally positioned into electrical connection against the inner walls of middle core portion 102.

Terminal element 112 also includes retainer portion 140 connected to the other end of spine 114 opposite the end at which first sleeve 116(arms 124) is connected to the spine. Retainer portion 140 is positioned within inner core portion 100 of bushing 82 spaced proximate to contact portion 132, being separated form contact portion 138 by gap 142. Retainer portion 140 includes a substantially annular head ring 144 extended into socket 14 proximate to, that is, substantially at a level with inner rim 94 of bushing 82. Annular head ring 144 has a pair of arcuate arms 146 of equal length(FIG. 4) that do not meet leaving a slight gap between them. A plurality of biasable side strips 148 are connected to ring 144 and substantially forming a truncated cone 150 having a cone base 152 positioned opposite head ring 144. Side-strips 148 are movable between an inward biased position and an outward unbiased position. Side strips 148 are in the unbiased position as seen in FIG. 3 and also as seen in FIG. 4. As seen in FIG. 3, cone base 152 is in contact with shoulder 106 of bushing 82 so that terminal element 112 is prevented from being moved outwardly from socket 14 in core 84 of the bushing. During the insertion of terminal element 112 into core 84, the walls of biasable side strips 148 are moved from their unbiased positions to their biased positions when side strips 148 pass along sloped guide 108 to middle core portion 102; side strips 148, upon core base 152 passing shoulder 106, are self-biased into their unbiased positions as illustrated in FIG. 3. In this last described position that terminal element 112 is prevented from sliding outwardly in bushing 82 from socket 14 and is permanently fitted into the bushing.

Terminal element 112 is prevented from sliding within bushing 82 towards socket 14 as follows. First, outwardly biased contact portion 132 is self-biased against the inner walls of middle core portion 102 at contact surface 138. Second, outwardly biased side strips 148 form the cone base 152 which has a greater diameter in a completely unbiased position in FIG. 4 than its diameter in FIG. 3, is partly biased at the inner diameter of inner core portion 100. This causes an outward biased contact between side strips 148 at their cone base 152 and the core walls of bushing 82 at inner core portion 100, which biased contact inhibits the movement of terminal element 112 in hollow core 84.

It is to be noted that terminal element 112 has four portions, namely, first sleeve 116, second sleeve 118, contact portion 132, and retainer portion 140, and that the first three of these have paired arms 124,126, and 136, while the last has a plurality of strips 144 connected to paired arms 146 of ring 144. Each of the paired arms, not being joined, allows terminal element 112 to be initially stamped from a flat metal sheet and then shaped into the four portions. Because terminal element 112 is small, this structure allows inexpensive production.

The embodiment of the invention particularly disclosed and described herein above is presented merely as an example of the invention. Other embodiments, forms and modifications of the invention coming within the proper scope and spirit of the appended claims will, of course, readily suggest themselves to those skilled in the art. With regard to this, a particular embodiment that is apparent relates to second conductor 65. It is apparant that terminal element 112 can be substituted for prior art terminal element 67 simply by substituting the portion of contact arm 52 in depression 54 for flanged shell portion 20 as shown in FIG. 3, and, of course, to use the details of first passage 38, bushing 82, and terminal element 112 as described above.

What is claimed is:

1. A plug-in terminal system, in combination, comprising:

a body forming an approximately cylindrical socket having an end wall and an opposed open side, said end wall forming first and second passages extending between the inner and outer surfaces of said end wall, screw shell means mounted in said socket for receiving the base of an incandescent lamp and for providing an electrical connection to said base, bushing means mounted in said first passage, first and second insulated wire conductors having respective first and second leads, terminal means positoned in said bushing means, said bushing means being for permanently receiving and permanently holding said terminal means when said terminal means is plugged into said bushing means, said terminal means being for gripping said first lead and electrically connecting said first lead to said bushing means, said bushing means also being for electrically connecting said terminal means to said shell means, and electrical contact means in association with said second passage for providing an electrical connection between said second lead and said base of said base of said lamp, said first passage being counterboard from said outer surface of said end wall forming an annular stop ledge within said first passage, said bushing means including a bushing body having an external annular flange stop, said bushing body being positioned within said first passage, said flange stop being in contact with said ledge, said bushing body forming a central hollow core having an inner and an outer rim; and wherein said shell means includes a shell flange coextensive with a portion of said inner surface of said end wall, said shell flange forming a hole coextensive with said first passage, said inner rim of said core being engaged with said shell flange at said hole, whereby an electrical connection is made between said shell means and said bushing, said inner rim including an annular flared head having an annular edge in pressing contact with said shell flange, whereby said bushing is locked from moving outwardly in said first passage, and whereby said annular edge is in electrical connection with said shell flange, said hollow core of said bushing body including an inner core portion associated with said inner rim, said inner core portion having an inner diameter, a middle core portion connected to said inner core portion having a middle diameter, and an outer core portion connected to said middle core portion having an outer diameter, said middle diameter being smaller than said inner and outer diameters, an annular, shoulder being formed between said inner and middle core portion, and an annular sloped guide being formed between said middle and outer core portions, said terminal means including a terminal element permanently positioned within said hollow core of said bushing body, said terminal element including an elongated spine having opposed end portions, said terminal element including a first sleeve connected to one of said portions and a second sleeve connected to said spine spaced proximate to said first sleeve, the insulation of said first lead being positioned within and gripped by said first sleeve and the wire of said first lead being positioned within and gripped by said second sleeve, said terminal element further including a substantially annular contact portion connected to said spine proximate to said second sleeve, said contact portion being movable from an outward unbiased position to an inward biased position, said contact portion being positioned in biased contact with the inner surface of said middle core portion of said bushing body; whereby said contact portion is moved between said unbiased position to said biased position during the movement of said contact portion from said outer core portion along said sloped guide to said middle core portion, electrical contact is made between said terminal element and said bushing body, and said contact portion inhibits the movement of said terminal body inwardly toward said socket.

2. A system according to claim 1, wherein said terminal element further includes a retainer portion connected to the other of said end portions, said retainer portion having a substantially annular head ring extended into said socket proximate to said inner rim of said core of said bushing body, said retainer portion further having a plurality of biasable side strips connected to said ring substantially forming a truncated cone having a cone base opposite said ring, said side strips being movable between outward unbiased positions and inward biased positions, said retainer portion being positioned in said inner core portion and said cone base being in contact with said shoulder of said bushing, whereby said terminal element is prevented from being moved outwardly in said core of said bushing body, and whereby said biasable strips are moved inwardly from said unbiased positions to said biased positions during movement of said retainer portion into said core along said sloped guide to said middle core portion and then are self-biased outwardly upon movement of said base of said cone past said shoulder.

3. A system according to claim 1, wherein said cone base has a base diameter greater than said inner diameter of said inner core portion, whereby said biasable strips are in biased contact with the inner walls of said inner core portion of said hollow core of said bushing body and said terminal element is inhibited from moving inwardly.

4. The system according to claim 1, wherein said first sleeve is spaced from said second sleeve, said first sleeve having an outer diameter closely approximating said outer diameter of said outer core portion of said hollow core, whereby said first sleeve absorbs bending strain when said first conductor is bent.

5. The system according to claim 1, wherein said first sleeve, said second sleeve, and said contact portion and said head of said retainer portion each include a pair of opposed arms configured to form said first and second sleeves, said contact portion, and said head, whereby said terminal element can be constructed from a flat preformed piece of material.

6. The system according to claim 1, wherein said bushing means is made of brass.

7. The system according to claim 1, wherein said terminal means is made of phospher bronze.

* * * * *